US009062694B2

(12) United States Patent
Fletcher et al.

(10) Patent No.: US 9,062,694 B2
(45) Date of Patent: Jun. 23, 2015

(54) LINEAR ACTUATOR AND POSITION SENSING APPARATUS THEREFOR

(75) Inventors: Bruce Fletcher, Oldham (GB); Michael John Fawcett, Bury (GB); Robert Gething, Knutsford (GB)

(73) Assignee: ROTA ENGINEERING LIMITED, Bury (GB)

( * ) Notice: Subject to any disclaimer, the term of this patent is extended or adjusted under 35 U.S.C. 154(b) by 1163 days.

(21) Appl. No.: 13/003,941

(22) PCT Filed: Jul. 14, 2009

(86) PCT No.: PCT/GB2009/001732

§ 371 (c)(1),
(2), (4) Date: Jan. 13, 2011

(87) PCT Pub. No.: WO2010/007357

PCT Pub. Date: Jan. 21, 2010

(65) Prior Publication Data

US 2011/0120300 A1 May 26, 2011

(30) Foreign Application Priority Data

Jul. 15, 2008 (GB) ..... 0812903.3

(51) Int. Cl.
*F15B 15/28* (2006.01)
*F15B 15/14* (2006.01)

(52) U.S. Cl.
CPC ..... *F15B 15/2861* (2013.01); *Y10T 29/49716* (2015.01); *Y10T 29/49238* (2015.01); *F15B 15/1447* (2013.01)

(58) Field of Classification Search
CPC ..... F15B 15/2861
USPC ..... 92/5 R, 5 L
See application file for complete search history.

(56) References Cited

U.S. PATENT DOCUMENTS 4,378,726 A * 4/1983 Stoll ..... 92/243
4,896,584 A * 1/1990 Stoll et al. ..... 92/5 R
5,231,352 A 7/1993 Huber (Continued)

FOREIGN PATENT DOCUMENTS

DE 202005005508 U1 6/2005
DE 102006009829 A1 9/2006
EP 0966653 B1 5/2003

(Continued)

OTHER PUBLICATIONS

PCT/GB2009/001732 International Search Report, Dec. 4, 2009 (3 p.).

*Primary Examiner* — F. Daniel Lopez
(74) *Attorney, Agent, or Firm* — Conley Rose, P.C.

(57) ABSTRACT

A linear actuator such as a hydraulic cylinder has linear position sensing apparatus. At least one magnet is provided in a recess in outer surface of the piston for generating a magnetic field that passes through the wall of the cylinder housing. A magnetic sensor arrangement determines the axial position of the piston relative to the housing and comprises at least a pair of magnetic sensor elements arranged at spaced apart locations along the external surface of the wall for sensing the strength of the magnetic field passing through the wall of the housing. The recess in the piston is axially positioned between the first and second end surfaces of the piston and the at least one magnet is disposed between axially spaced north and south pole pieces.

9 Claims, 5 Drawing Sheets

(56) References Cited

U.S. PATENT DOCUMENTS

| | | | | |
|---|---|---|---|---|
| 6,346,806 | B1 | 2/2002 | Schabuble et al. | |
| 7,557,568 | B2 * | 7/2009 | Terasaki | 324/207.2 |

FOREIGN PATENT DOCUMENTS

| | | | |
|---|---|---|---|
| EP | 1895170 | A1 | 3/2008 |
| WO | 2007064271 | A1 | 6/2007 |

* cited by examiner

LINEAR ACTUATOR AND POSITION SENSING APPARATUS THEREFOR

CROSS REFERENCE TO RELATED APPLICATIONS

This application is a 35 U.S.C. §371 national stage application of PCT/GB2009/001732 filed Jul. 14, 2009, which claims the benefit of British Patent Application No. 0812903.3 filed Jul. 15, 2008, both of which are incorporated herein by reference in its entireties for all purposes.

STATEMENT REGARDING FEDERALLY-SPONSORED RESEARCH OR DEVELOPMENT

Not applicable.

BACKGROUND

The present invention relates to a linear actuator and linear position sensing apparatus for detecting the position of the linear actuator such as, for example, a hydraulic or pneumatic cylinder.

In many applications where hydraulic or pneumatic cylinder actuators are used to control the movement or positioning of an object it is often desirable to determine the displacement of the actuator.

A typical hydraulic or pneumatic piston actuator comprises a cylinder that houses a slidable piston and piston rod assembly arranged for reciprocal movement in the axial direction. The piston is sealed to the inside surface of the cylinder so as to divide the cylinder into two chambers and is moveable, under the influence of hydraulic or pneumatic fluid introduced under pressure into one or other of the chambers, between a retracted stroke position in which the piston rod is substantially wholly received within the housing and an extended stroke position in which the length of the rod projects out of the housing. The movement of the piston is typically effected by using one or more control valves to introduce the fluid into the chambers. In order to ensure accurate positioning it is desirable to operate the control valves in response to a feedback signal representing the position of the piston or piston rod relative to the cylinder in which case it is necessary to have the ability to sense the stroke position of the piston or piston rod in an accurate manner.

The conventional approach to incorporating a position sensor in a linear actuator of this kind is to drill a bore along the longitudinal axis of the piston rod into which at least part of a sensor arrangement can be fitted. One example of such a sensor is a linear voltage displacement transducer. Another is a magnetostrictive transducer comprising an elongate waveguide disposed in the bore and a magnet arranged around the piston rod such that its magnetic field is directed along the waveguide. Current pulses are sent from a sensor fixed in the cylinder and propagate along the waveguide. The magnetic field generated by each pulse interacts with the magnetic field of the magnet such that a mechanical strain is imparted in the waveguide. This strain is sensed and converted into an electrical pulse and the position of the magnet relative to the waveguide can be determined from the time taken for the pulse to travel the distance between the magnet and the sensor.

In another example a series of Hall-effect sensors or reeds are arranged in linear array in a tube along the bore in the piston rod and a permanent magnet fitted to the piston rod slides relative to the tube thus activating each of the sensors in turn.

The machining of a bore in the piston rod to accommodate part of the sensor assembly is undesirable as it increases the manufacturing cost and potentially weakens the actuator. This is particularly a problem with long stroke cylinder actuators.

An alternative approach is to use a sensor external to the cylinder and a magnet with pole pieces attached to the piston. This involves adapting the piston in such a manner that additional components increase its length resulting in either a reduced actuator stroke or the need to extend the length of the cylinder both which incurs undesirable additional manufacturing costs. It has also been realised that the exposure of the magnet and/or pole pieces to the end forces applied to the piston by high pressure within the cylinder can affect the integrity of the magnets which in turn affects the accuracy of the readings.

External sensors are often impractical as the actuators are used in harsh environments. Moreover, many hydraulic linear actuators are operated under significant pressure and so the cylinder tends to be made from thick steel. This renders the use of magnetic-based sensors problematic as the ferromagnetic properties of the thick steel cylinder means that the magnetic flux generated by the magnet is generally shielded from the external sensor and is generally not of sufficient density such that it can be sensed accurately.

SUMMARY

It is an object of the present invention, amongst others, to obviate or mitigate the aforementioned disadvantages. It is also an object to provide for an improved linear position sensor for use with actuators of the kind described above.

According to a first aspect of the present invention there is provided a linear actuator comprising a piston and a housing, the piston disposed inside the housing for reciprocal movement along an axis, the housing having a wall with an internal surface and an external surface, the piston having first and second axially spaced end surfaces, at least a first chamber defined between one of the first and second end surfaces and the internal surface of the wall for receipt of actuating fluid, the piston having at least one magnetic field generator for generating a magnetic field that passes through the wall of the housing, and a magnetic sensor arrangement for determining the axial position of the piston relative to the housing, the sensor arrangement comprising at least a pair of magnetic sensor elements arranged on an opposite side of the wall to the piston at axially spaced locations with respect to the external surface of the wall for sensing the strength of the magnetic field passing through the wall of the housing, wherein the at least one magnetic field generator is disposed in a recess defined in an external surface of the piston, the recess being axially positioned between the first and second end surfaces of the piston.

The magnetic field generator may comprise any component or assembly of components that is configured to generate the magnetic field. In particular it may comprise simply one or more magnets. Alternatively it may comprise one or more magnets and associated pole pieces of magnetically conducting material.

The magnetic sensor arrangement is preferably of a non-contact type, that is, the arrangement does not rely upon magnetically conductive elements in contact with the wall for drawing the magnetic field out of the wall. It may be disposed such that it is radially spaced from the external surface of the wall. An insulating material may be disposed in the radial space between the external surface of the wall and sensor arrangement.

The north and south pole-pieces may be integral parts of piston or may be separate components. They preferably have outer edges that are in close proximity to the wall of the housing so as to conduct the magnetic field into and through the wall.

There may be provided a holder of magnetically insulating material in which the magnetic field generator is housed, the holder being received in said recess in the piston. In the instance where there are north and south pole pieces and they are separate components they may be supported in the holder on each side of the magnet. The holder may have a pair of pockets for supporting the pole pieces. The pockets may be separated by an intermediate wall of the holder in which the at least one magnet is supported. The pole pieces are preferably arranged such that their radially outermost surfaces are immediately adjacent to the inner surface of the wall of the housing.

The recess in the piston may be in the form of a slot defined by removal material from the external surface of the piston.

The piston and housing are preferably cylindrical but may take any other suitable shape. The slot may be in the form of a segment removed from the piston, preferably a minor segment.

The holder may be slidably receivable in the slot and may not be retained by fixing members. It may have a bore in which the magnet is received. The intermediate wall in the holder may be penetrated by the bore in which the magnetic field generator is supported.

The outer surface of the holder may be substantially flush with the outer external surface of the piston.

The wall of the housing may be made of ferromagnetic material or otherwise.

In one preferred embodiment the surface area of the radially outermost surface of each of the north and south pole pieces may be equal to or greater than the surface area of the corresponding north of south pole surface of the magnet or, in the case where there is more than one magnet, greater than the surface area of the combined corresponding north or south pole surfaces of the magnet.

There may be a taper or chamfer on the radially outermost surface of each of the pole pieces in order to provide a concentrated magnetic field.

The magnetic sensor arrangement may further comprise a magnetic field generator configured to apply a biasing magnetic field to the sensor elements. This may comprise an elongate permanent magnet or an elongate strip of magnetisable material connected to at least one magnet or electromagnet. The sensor elements may be arranged in a linear array and the magnetic field generator may be arranged over the array sensor elements so as to be substantially parallel thereto.

In another preferred embodiment the distance between the north and south pole pieces is equal to, or greater than, the thickness of the wall of the housing.

The piston may be mounted on a piston rod that extends in the housing and has a first end that projects out of the housing, preferably through an end fitting in the housing. The piston may be mounted on, or connected to, a second end of the piston rod or, alternatively, the second end of the piston rod may also project out of the housing extend through an end fitting. The piston rod may comprise one or more sections.

According to a second aspect of the present invention there is provided position sensing apparatus for determining the displacement of a linear actuator having a piston and a housing, the piston disposed inside the housing for reciprocal movement along an axis, the housing having a wall with an internal surface and an external surface, the piston having first and second axially spaced end surfaces, at least a first chamber defined between one of the first and second end surfaces and the internal surface of the wall for receipt of actuating fluid, the apparatus comprising at least one magnetic field generator for generating a magnetic field that passes through the wall of the housing, a holder of magnetically insulating material for supporting the at least one magnetic field generator, optionally between axially spaced north and south pole pieces, and for insertion into a recess in the external surface of the piston, and a magnetic sensor arrangement for determining the axial position of the piston relative to the housing, the sensor arrangement comprising at least a pair of magnetic sensor elements configured for location on an opposite side of the wall to the piston at spaced apart locations with respect to the external surface of the wall for sensing the strength of the magnetic field passing through the wall of the housing.

According to a third aspect of the present invention there is provided a method for providing a linear actuator having a piston and a housing with position sensing apparatus, the method comprising removing the piston from the housing, removing material from an external surface of the piston so as to define a recess between end surfaces of the piston, placing a holder containing a magnetic field generator in the recess and replacing the piston within the housing, fitting a magnetic sensor arrangement for determining the axial position of the magnet relative to the housing, the sensor arrangement comprising at least a pair of magnetic sensor elements configured for location at spaced apart locations with respect to the external surface of the wall for sensing the strength of the magnetic field passing through the wall of the housing.

Specific embodiments of the present invention will now be described, by way of example only, with reference to the accompanying drawings in which.

Figure 9:
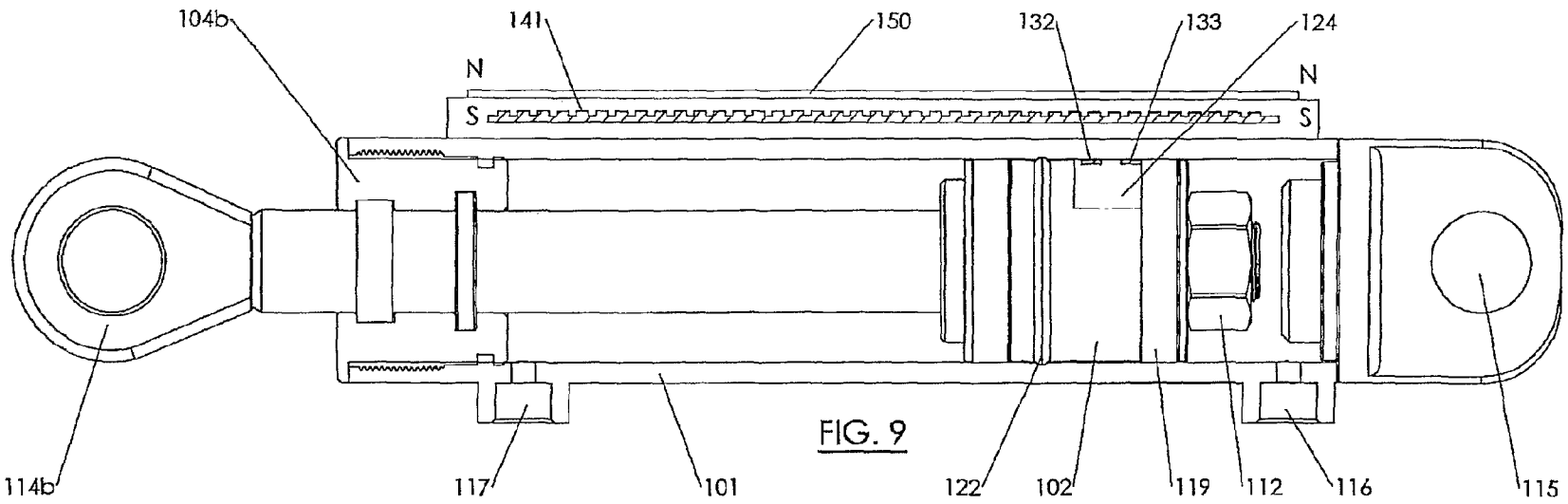
Figure 10:
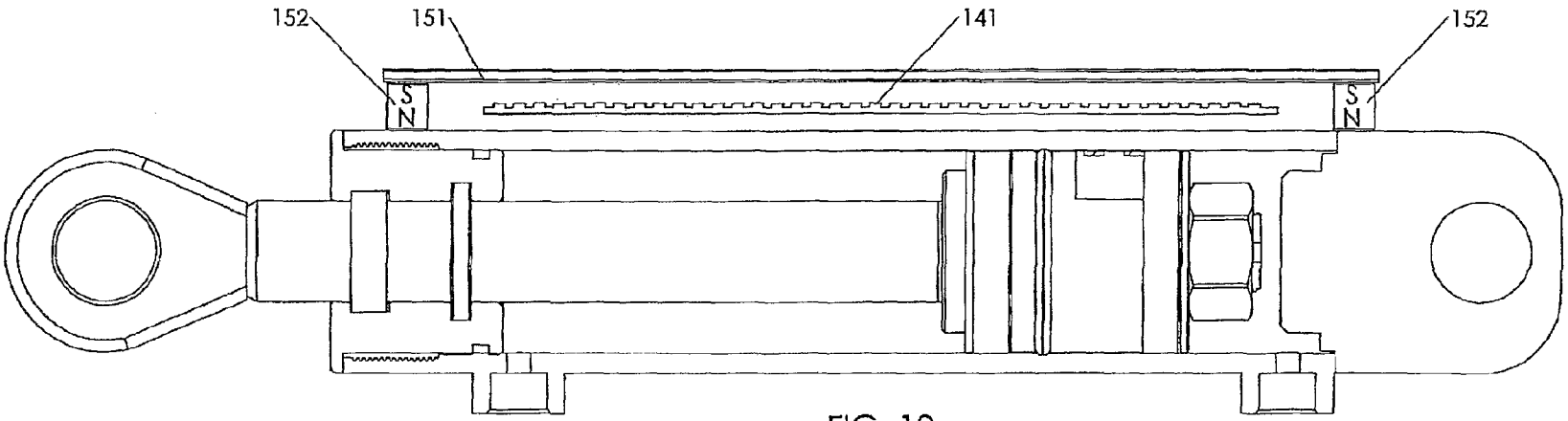
Figure 11:
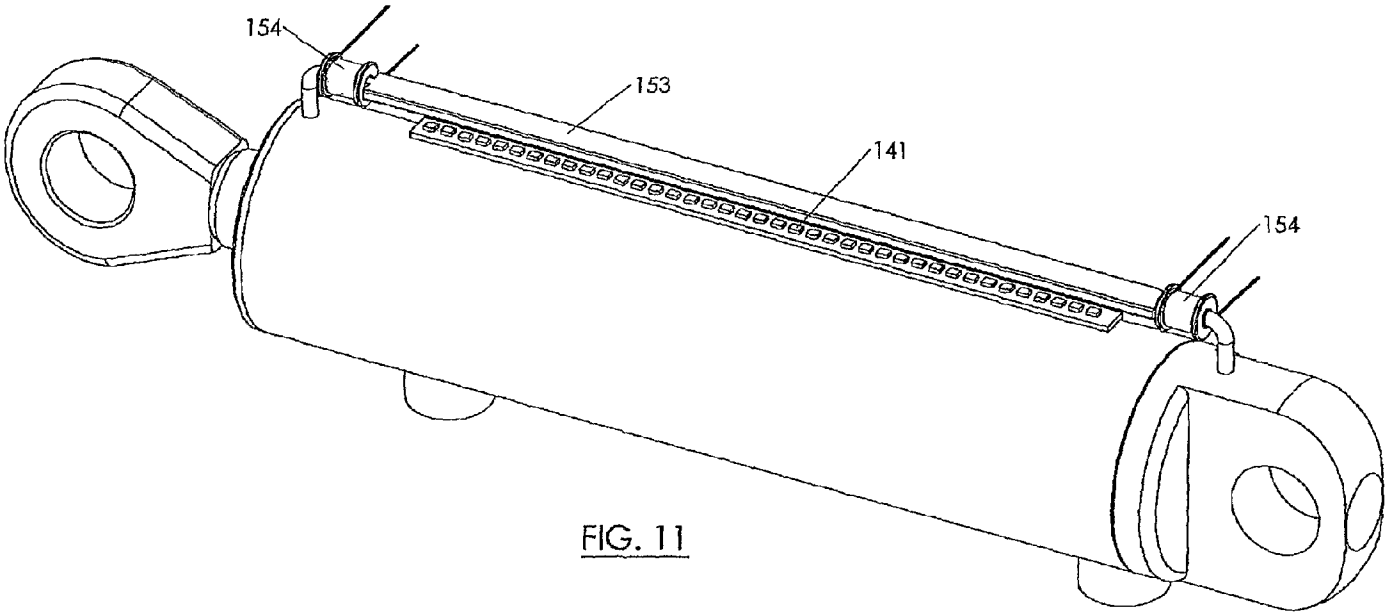
Figure 12:
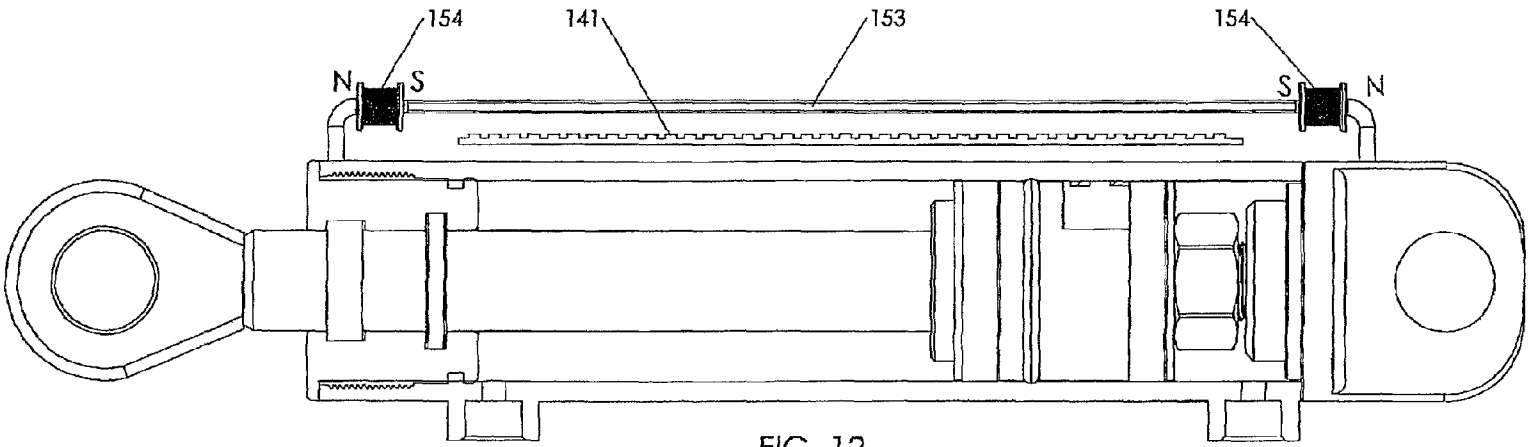

FIGS. 8*a*-8*f* are perspective views of alternative magnet and pole piece arrangements in accordance with the present invention;

FIG. 9 is an axial, partially sectioned view of the actuator with an alternative linear position sensor arrangement in accordance with the present invention;

FIG. 10 is an axial, partially sectioned view of the actuator with a further alternative linear position sensor arrangement in accordance with the present invention;

FIG. 11 is a perspective view of the actuator with a yet further alternative embodiment of the linear position sensor arrangement; and FIG. 12 is an axial, partially sectioned view of the actuator and linear position sensor arrangement of FIG. 11.

DETAILED DESCRIPTION

Referring now to the FIGS. 1 to 7, the exemplary linear actuator comprises a housing in the form of a cylinder 1 and a reciprocal piston 2. The cylinder 1 defines a wall 3 of ferromagnetic material, such as steel, and has, end fittings 4*a*, 4*b* so as to define an internal chamber 5 in which the piston 2 slidably disposed.

The piston 2 is cylindrical with first and second end surfaces 6, 7 penetrated by a central bore 8. It is concentrically mounted on a piston rod 9 towards a first end and is fixed axially relative to the rod 9 by means of complementary radial steps 10, 11 defined at an interface between the internal surface of the bore 8 and the external surface of the rod 9 and a nut 12 that is secured to a thread defined at the first end 13 of the rod. A second end 14 of the piston rod 9 projects outside the cylinder though a bore in the second end fitting 4*b* and terminates in an eyelet 14*b* for connection to a first component. The first end fitting 4*a* has an eyelet 15 for connection to a second component, the first and second components designed to be movable relative to one another by the actuator.

Figure 1:
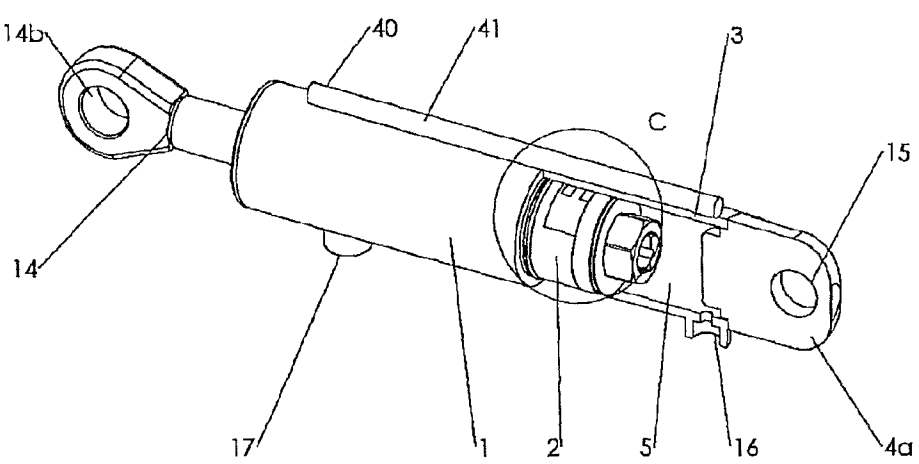
FIG. 1 is a perspective view of a hydraulic cylinder actuator shown partially cut-away and fitted with a linear position sensor in accordance with the present invention.
Figure 2:
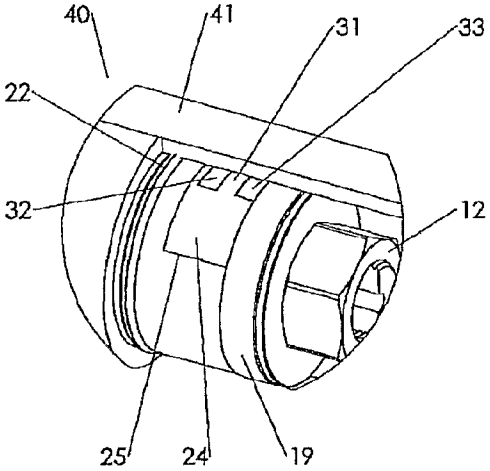
FIG. 2 is an enlarged view of a piston of the actuator encircled and labelled C in FIG. 1.
Figure 3:
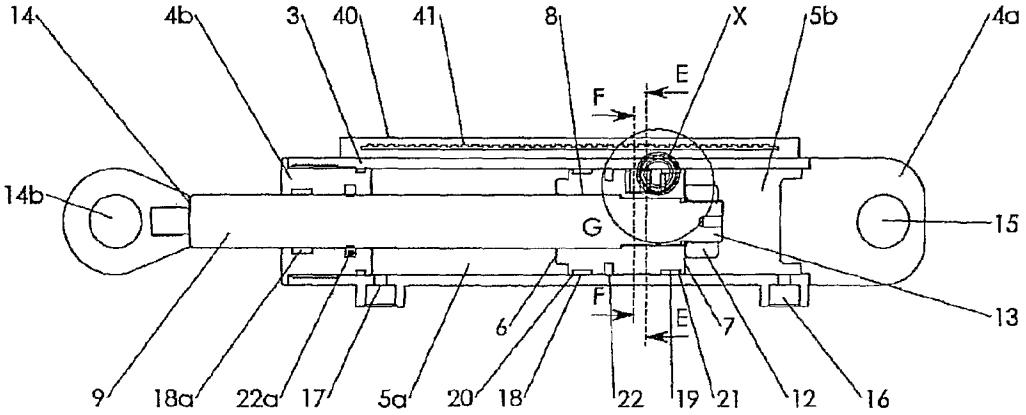
FIG. 3 is an axial sectioned view of the actuator of FIG. 1.

The piston 2 serves to divide the chamber 5 into two variable volume sections 5*a*, 5*b* for receipt of hydraulic fluid, as is best seen in FIG. 3. Ports 16, 17 penetrate the wall 3 axially inboard of each end fitting 4*a*, 4*b* and allow hydraulic fluid to be delivered or removed so as to alter the fluid pressure within the respective chamber sections 5*a*, 5*b* and effect movement of the piston 2 within the cylinder 1.

The sliding movement of the piston 2 in the cylinder 1 is supported by bearing rings 18, 19 that are disposed in annular grooves 20, 21 defined in the external surface of the piston 2 which, in use, bear against the internal surface of the cylinder wall 3. Similarly, a bearing ring 18*a* is provided in the second end fitting 4*b* for the same purpose. A third annular groove in the piston 2 supports an annular seal 22 that prevents leakage of the hydraulic fluid across the piston 2. A similar annular seal 22*a* is provided in a groove in the second end fitting 4*b* to prevent leakage of hydraulic from the cylinder at that end. It will be appreciated that any suitable number of bearing rings and seals may be provided.

In order to detect the displacement of the piston rod 9 relative to the cylinder 1, the piston 2 is fitted with a permanent magnet 23 whose magnetic field can be sensed by an appropriate sensor. The magnet 23 is retained in a holder 24 disposed in a slot 25 defined between the end surfaces 6, 7 of the piston 2. The slot 25, which has a flat bottom surface 26, is formed by machining the external surface of the piston 2 to remove a minor segment of the cylindrical form defined by the piston 2.

Figure 4:
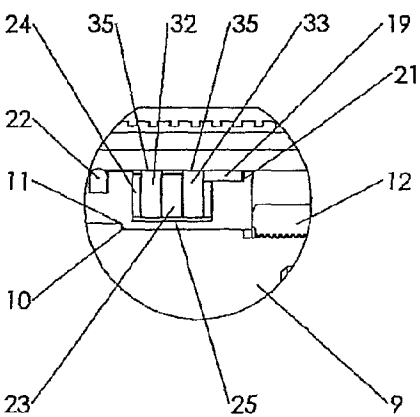
FIG. 4 is an enlarged view of part of the actuator of FIG. 3 that is encircled and labelled G.
Figure 6:
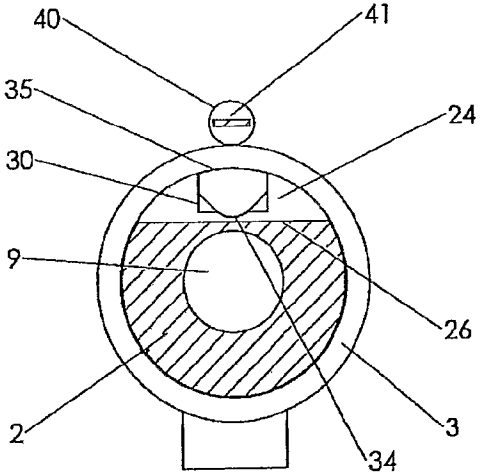
FIG. 6 is a sectioned view along line F-F of FIG. 3.
Figure 5:
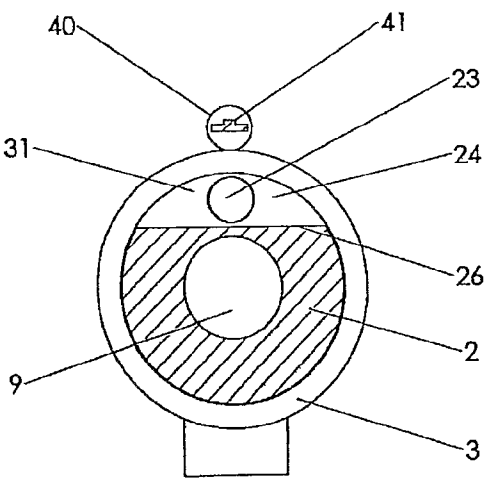
FIG. 5 is a sectioned view along line E-E of FIG. 3.
Figure 7:
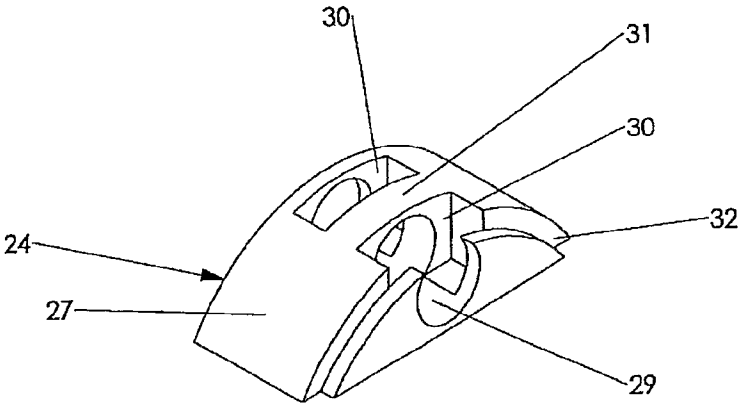
FIG. 7 is a perspective view of a magnet holder of the actuator of FIGS. 1 to 6.

FIG. 7 shows the magnet holder 24 in an empty condition i.e. without magnet 23 present. It comprises a minor section of a solid cylinder that is formed from a suitable magnetic insulator material. For example, it may be moulded from a suitable plastics material, or it may be machined from aluminium, brass, nylon or the like or may even be extruded from a suitable material. The holder 24 is designed to fill the slot 25 such that it "completes" the piston as illustrated in FIGS. 1 to 6 and therefore has an arcuate outer surface 27 that completes the cylindrical form of the piston 2 and an inner flat surface 28 for resting on the flat bottom surface 26 of the slot 25. It also has a central bore 29 extending in an axial direction with regard to the elongate axis of the cylinder 1, which bore 29 is interrupted by two radially extending pockets 30 so as to define between them an intermediate wall 31 penetrated by the bore 29. One end of the holder 24 is stepped inwardly in a radial direction at 32 to receive an edge of one of the bearing rings 19. In use, and as illustrated in FIGS. 1 to 6, the holder 24 receives a permanent magnet 23 that is retained in the central bore 29 in the intermediate wall 31 between north and south pole pieces 32, 33 that are received in respective pockets 30. This is best seen in FIG. 4. Each of the pole pieces 32, 33 is in the form of a cylindrical with a convexly arcuate inner end 34 (see FIG. 6) for location in the bottom of the central bore 29.

Integrating the magnet holder 24, pole pieces 32, 33 and magnet 23 into the piston 2 and actuator is a simple operation. The magnet 23 is simply pushed into the central bore 29 in the intermediate wall 31 of the holder 24 and the two pole pieces 32, 33 are then dropped into the respective pockets 30 such that their radially outer edges 35 are more or less flush with the outer arcuate surface 27 of the holder 24. The holder 24 is then slid into the slot 25 in the piston 2, the bearing rings 18, 19 and seal 22 fitted, and the piston 2 mounted on the piston rod 9 for insertion into the cylinder 1. Once the piston 2 and rod 9 are in place the outer edges 35 of the pole pieces 32, 33 are in close proximity to the inside surface of the cylinder wall 3 such that the magnetic field generated in the cylinder wall has sufficient flux strength and density for it to be detected by an external sensor. The magnetic field generated is illustrated schematically at X in FIG. 3. No retaining fixtures are required to secure the holder 24 to the piston 2.

It is to be appreciated that more than one magnet may be used in other embodiments of the invention. Any convenient shape of magnet may be used that can be accommodated in a recess in the piston 2, including an annular shape. The permanent magnet(s) may be made from a high strength material such as, for example, neodymium.

The term "pole piece" is used throughout to mean any structure that co-operates with a magnet to generate a magnetic field having a flux density of a desired characteristic.

A magnetic field sensor arrangement is supported in a tubular housing 40 mounted on the external surface of the cylinder 1 and comprises, for example, a linear array of spaced Hall-effect sensor elements 41, although it is to be appreciated that other non-contact sensor elements suitable for detecting a magnetic field may be used such as, for example, an array of reed switches with a resistive ladder, magneto-resistive elements or GMR (giant magneto-resistive) technology. In the example of the Hall-effect sensors, a voltage is generated by each sensor that is proportional to the strength of the detected magnetic field. Although not shown as such in the figures, the sensor arrangement may be disposed on an insulating material between them and the external surface of the cylinder 1. This may serve to prevent heat generated through movement of the piston in the cylinder and passing through the wall of the cylinder from affecting the performance of the sensor arrangement.

In operation, the magnetic field generated by the permanent magnet 23 passes through and out of the cylinder wall 3 between the north and south pole pieces 32, 33, the flux lines being depicted at X in FIG. 3. By positioning the magnet 23 in a region close to the wall 3 the magnetic flux is of sufficient density for it to be detected by a magnetic sensor despite the cylinder wall 3 being of a ferromagnetic material. The precise position of the piston 2 relative to the housing wall 3 can be determined by using the array of Hall-effect sensor elements 41 that are arranged in a linearly spaced relationship on a support board (e.g. a printed circuit board) along the tube 40 and adjacent to, but spaced radially from, the cylinder wall 3. For a given position of the piston 2 in the cylinder 1 each sensor element 41 will sense a magnetic field strength and generate an output voltage signal. More specifically, the sensor element 41 that is closest to the axial position of the magnet 23 will generate voltage representative of the strongest magnetic field and those sensor elements adjacent to the closest sensor element will detect the next strongest magnetic field. Voltage signals are simultaneously collected by signal processing circuitry from a pre-selected number of sensor elements 41 and can be processed using an appropriate algorithm to determine the precise position of the piston 2.

In order for the arrangement to work effectively the surface area of radially outer edge 35 of each pole piece 32, 33 (i.e. facing the inside surface of the cylinder) should be equal to, or greater than, the surface area of the respective (i.e. north or south) surface of the magnet 23 or magnets. Moreover, the axial distance between the pole pieces 32, 33 (i.e. the thickness of the intermediate wall 31 of the holder between the two pockets 30) should be equal to or greater than the thickness of the wall 3 of the cylinder 1.

The arrangement allows the magnetic field to pass through the wall of the cylinder 1 such that it can be detected by an appropriate sensor that does not have to be in contact with the wall. Such an arrangement is inherently more reliable than using a sensor arrangement that relies on using a magnetic conductor in contact with the cylinder wall to direct the field to the sensor for detection.

The containment of the holder 24 and magnet 23 in the slot 25 in the outer surface of the piston 2 itself is advantageous for several reasons. First, it means that the sensor arrangement can be mounted externally of the cylinder 1 and therefore the complex and expensive machining operations required to accommodate prior art sensors mounted in a bore in the piston rod are eliminated. Secondly, any increase in the length of the piston to accommodate the magnet assembly is, in most cases, much less than it would otherwise be with prior art designs such that the minimum distance between the centres of the eyelets 14*b* and 15, and therefore the length of the actuator stroke, is not compromised significantly. Thirdly, by being encompassed within the piston 2, the holder 24 and therefore the magnet 23 is not subjected to the end loading applied by the fluid within the hydraulic cylinder and so no deleterious compressive forces are applied to the magnet 23. Furthermore, the arrangement is very simple and quick to incorporate into existing piston and cylinder actuators. Moreover, by using a holder 23 and pole pieces 32, 33 in the form of a segment the machining operation required to modify the existing actuator is relatively inexpensive to perform. The mounting arrangement also allows the amount of expensive magnet material to be reduced. This is particularly important in relation to applications where the environment in which the actuator operates is at elevated temperature or the hydraulic fluid is raised to high temperatures as under such conditions the strength of the magnetic field is generally weakened and more magnetic material would otherwise be used to attain sufficient signal strength at the sensor.

Figure 8:
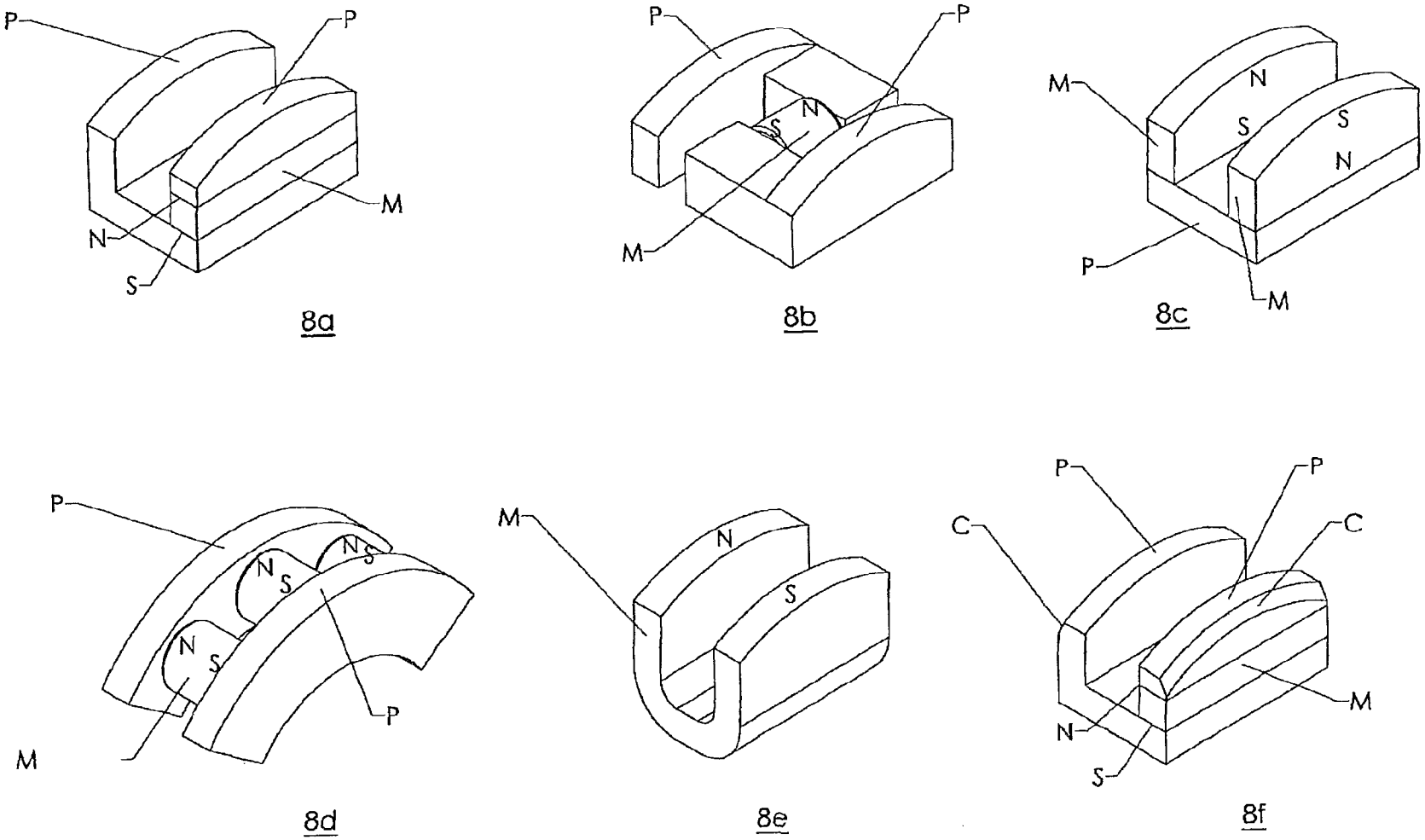

Alternative examples of arrangement of the permanent magnet and pole pieces are shown in FIGS. 8*a*-8*f*. In each case they are designed to be housed in a suitably shaped magnet holder of magnetically insulating material which leaves exposed upper arcuate surfaces of the magnet or magnetic pole pieces for directing the magnetic field into the wall of the cylinder 1. In each case the permanent magnet is marked by reference M and the north and south poles of the magnet by N and S respectively whereas the pole pieces of are each indicated by reference P. In FIG. 8*a* the magnet M is a rectangular strip sandwiched between pole pieces P, to form a generally U-shaped magnetic assembly, the magnet M being disposed in one of the limbs of the U. In FIG. 8*b*, the magnet M is a cylindrical shape positioned between two L-shaped pole pieces. In FIG. 8*c*, there is a pair of spaced upstanding magnets M with arcuate upper surfaces supported on a pole piece P. In FIG. 8*d* three cylindrical magnets M are disposed between arcuate pole pieces P. FIG. 8*e* illustrates an example of a magnet with integral upstanding pole pieces which eliminates the need for separate pole piece components. FIG. 8*f* shows an embodiment very similar to that of FIG. 8*a* but with the upper surfaces of the pole pieces P having a chamfer or taper C to increase the concentration of the magnetic field.

A modification to the linear position sensing arrangement is shown in FIG. 9. In this embodiment, the cylinder, but not the piston, is shown in section. Components that are common to the embodiment of FIGS. 1 to 7 are given the same reference numerals but increased by 100 and are not described further except in so far as they differ from their counterparts. The Hall-effect sensor elements 141 are supplemented with a strip of magnetic material 150 arranged with one of its poles (in this case south) facing the sensor elements 141. The strip 150 extends in parallel to the array of sensor elements 141 and is substantially coterminous therewith. The magnetic field provided by the strip 150 serves to "pre-load" or bias the sensor elements so that a correspondingly reduced magnetic flux density from the magnetic arrangement is sufficient for the sensor elements 41 to function effectively. This allows a reduction in the amount of magnetic material required in the relative harsh environment of inside the cylinder 101.

FIG. 10 shows a further variation to the linear position sensing arrangement that is designed to achieve the same effect as the embodiment of FIG. 9. Instead of a strip of magnetic material there is provided a rod of steel 151 (or other suitable magnetisable material) is supported on a pair of spaced magnets 152 whose poles are oriented such that they generate a magnetic field in the strip that acts in the same manner as the magnetic strip 150 of FIG. 9.

A further variation to the FIGS. 9 and 10 embodiments is illustrated in FIGS. 11 and 12. In this instance the magnetic field for biasing the sensor elements 141 is generated in a steel rod 153 by a pair of electromagnets 154 connected to an electrical source (not shown).

It will be appreciated the numerous modifications and variations to the embodiment described may be made without departing from the scope of the invention as defined by the appended claims. For example, the sensing arrangement may be used with cylinders made of any suitable material and not necessarily those that are ferromagnetic, although the present invention is particularly advantageous in relation to ferromagnetic cylinders. The cylinder may have a recess formed in its outer surface by which it may be supported during manufacturing, assembly or installation. Such a recess may be annular or partially annular. The sensor arrangement will be configured to accommodate the radial gap provided by this feature. They may be a radial clearance between the sensor arrangement and the cylinder wall in some instances where there are end fittings that are welded to the cylinder wall. The sensor arrangement may in such an instance be supported at each end in part of the end fitting radially outboard of the weld. Moreover, the sensing arrangement may comprise as little as two sensor elements in which case the position of the piston is detected only at two limits of the piston travel and thus serve, in effect, as limit switches. The invention is not necessarily limited to the linear actuator structure shown in the figures but may, for example, be used in relation to a steering cylinder design in which the ends of the piston rod extend out of respective ends of the housing for connection to respective components and the piston is disposed on the piston rod between the two rod ends. In another example, a magnetic shield may be positioned around the sensor element or array to prevent an external magnetic field from influencing the signal from the magnets associated with the piston. This may be in the form of for example, an angle section. Similarly any form of mechanical housing may be provided around the sensor elements as protection.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A hydraulic linear actuator comprising a cylindrical piston and a housing, the piston disposed inside the housing for reciprocal movement along an axis, the housing having a wall made of ferromagnetic material with an internal surface and an external surface, the piston having axially spaced first and second end surfaces, at least a first chamber defined between one of the first and second end surfaces and the internal surface of the wall for receipt of actuating fluid, the piston having at least one magnetic field generator for generating a magnetic field that passes through and out of the wall of the housing, and a magnetic sensor arrangement for determining the axial position of the piston relative to the housing, the sensor arrangement comprising at least a pair of magnetic sensor elements arranged on the opposite side of the wall to the piston at axially spaced locations with respect to the external surface of the wall for sensing the strength of the magnetic field passing through and out of the wall of the housing, wherein the at least one magnetic field generator is disposed in a recess defined in an external surface of the piston, the recess being axially positioned between the first and second end surfaces of the piston the recess having the shape of a segment of the cylindrical form of the piston and wherein there is provided a magnet holder of magnetically insulating material in which the magnetic field generator is supported, the magnet holder disposed in the recess in the piston, wherein the at least one magnetic field generator comprises at least one magnet disposed between axially spaced north and south pole pieces distinct from the piston, and the pole pieces are supported in the holder on each side of the magnet; and wherein the holder has a pair of pockets for supporting the pole pieces.

2. A linear actuator according to claim 1, wherein the pockets are axially separated by an intermediate wall of the holder, the at least one magnet being supported in the intermediate wall.

3. A hydraulic linear actuator comprising a cylindrical piston and a housing, the piston disposed inside the housing for reciprocal movement along an axis, the housing having a wall made of ferromagnetic material with an internal surface and an external surface, the piston having axially spaced first and second end surfaces, at least a first chamber defined between one of the first and second end surfaces and the internal surface of the wall for receipt of actuating fluid, the piston having at least one magnetic field generator for generating a magnetic field that passes through and out of the wall of the housing, and a magnetic sensor arrangement for determining the axial position of the piston relative to the housing, the sensor arrangement comprising at least a pair of magnetic sensor elements arranged on the opposite side of the wall to the piston at axially spaced locations with respect to the external surface of the wall for sensing the strength of the magnetic field passing through and out of the wall of the housing, wherein the at least one magnetic field generator is disposed in a recess defined in an external surface of the piston, the recess being axially positioned between the first and second end surfaces of the piston the recess having the shape of a segment of the cylindrical form of the piston and wherein there is provided a magnet holder of magnetically insulating material in which the magnetic field generator is supported, the magnet holder disposed in the recess in the piston, wherein the magnetic sensor arrangement further comprises a magnetic field generator on the opposite side of the wall to the piston and configured to apply a biasing magnetic field to the magnetic sensor element(s).

4. A linear actuator according to claim 3 wherein, wherein there is provided a plurality of magnetic sensor elements arranged in a linear array.

5. A linear actuator according to claim 4, wherein the magnetic field generator is disposed over the linear array of magnetic sensor elements so as to be substantially parallel thereto.

6. A hydraulic linear actuator comprising a cylindrical piston and a housing, the piston disposed inside the housing for reciprocal movement along an axis, the housing having a wall made of ferromagnetic material with an internal surface and an external surface, the piston having axially spaced first and second end surfaces, at least a first chamber defined between one of the first and second end surfaces and the internal surface of the wall for receipt of actuating fluid, the piston having at least one magnetic field generator for generating a magnetic field that passes through and out of the wall of the housing, and a magnetic sensor arrangement for determining the axial position of the piston relative to the housing, the sensor arrangement comprising at least a pair of magnetic sensor elements arranged on the opposite side of the wall to the piston at axially spaced locations with respect to the external surface of the wall for sensing the strength of the magnetic field passing through and out of the wall of the housing, wherein the at least one magnetic field generator is disposed in a recess defined in an external surface of the piston, the recess being axially positioned between the first and second end surfaces of the piston the recess having the shape of a segment of the cylindrical form of the piston and wherein there is provided a magnet holder of magnetically insulating material in which the magnetic field generator is supported, the magnet holder disposed in the recess in the piston; wherein the at least one magnetic field generator comprises a pair of spaced magnets supported on a pole piece, said spaced magnets each having an arcuate upper surface.

7. A position sensing apparatus for determining the displacement of a hydraulic linear actuator having a cylindrical piston and a housing, the piston disposed inside the housing for reciprocal movement along an axis, the housing having a ferromagnetic wall with an internal surface and an external surface, the piston having axially spaced first and second end surfaces, at least a first chamber defined between one of the first and second end surfaces and the internal surface of the wall for receipt of actuating fluid, the apparatus comprising at least one magnetic field generator for generating a magnetic field that passes through and out of the wall of the housing, a holder of magnetically insulating material for supporting the at least one magnetic field generator and shaped for insertion into a recess in the external surface of the piston, the recess having the shape of a segment of the cylindrical form of the piston and a magnetic sensor arrangement for determining the axial position of the piston relative to the housing, the sensor arrangement comprising at least a pair of magnetic sensor elements configured for location at axial spaced locations with respect to the external surface of the wall for sensing the strength of the magnetic field passing through and out of the wall of the housing; wherein the at least one magnetic field generator comprises a pair of spaced magnets supported on a pole piece, said spaced magnets each having an arcuate upper surface.

8. A hydraulic linear actuator comprising a cylindrical piston and a housing, the piston disposed inside the housing for reciprocal movement along an axis, the housing having a wall made of ferromagnetic material with an internal surface and an external surface, the piston having first and second axially spaced end surfaces, at least a first chamber defined between one of the first and second end surfaces and the internal surface of the wall for receipt of actuating fluid, the piston having at least one magnetic field generator for generating a magnetic field that passes through and out of the wall of the housing, and a magnetic sensor arrangement for determining the axial position of the piston relative to the housing, the sensor arrangement comprising at least a pair of magnetic sensor elements arranged on the opposite side of the wall to the piston at axially spaced locations with respect to the external surface of the wall for sensing the strength of the magnetic field passing through and out of the wall of the housing, wherein the at least one magnetic field generator is disposed in a recess in the piston, wherein the magnetic sensor arrangement further comprises a magnetic field generator on the opposite side of the wall to the piston and configured to apply a biasing magnetic field to the magnetic sensor element(s).

9. A position sensing apparatus for determining the displacement of a hydraulic linear actuator having a cylindrical piston and a housing, the piston disposed inside the housing for reciprocal movement along an axis, the housing having a ferromagnetic wall with an internal surface and an external surface, the piston having first and second axially spaced end surfaces, at least a first chamber defined between one of the first and second end surfaces and the internal surface of the wall for receipt of actuating fluid, the apparatus comprising at least one magnetic field generator for generating a magnetic field that passes through and out of the wall of the housing, a holder of magnetically insulating material for supporting the at least one magnetic field generator and shaped for insertion into a recess in the piston, and a magnetic sensor arrangement for determining the axial position of the piston relative to the housing, the sensor arrangement comprising at least a pair of magnetic sensor elements configured for location at axial spaced locations with respect to the external surface of the wall for sensing the strength of the magnetic field passing through and out of the wall of the housing, wherein the magnetic sensor arrangement further comprises a magnetic field generator on the opposite side of the wall to the piston and configured to apply a biasing magnetic field to the magnetic sensor element(s).

* * * * *